US012716037B2

(12) United States Patent
Peinado et al.

(10) Patent No.: US 12,716,037 B2
(45) Date of Patent: Aug. 25, 2026

(54) PROCESS TO MAKE FINISHED BASE OILS AND WHITE OILS FROM DEWAXED BULK BASE OILS

(71) Applicant: CHEVRON U.S.A. INC., San Ramon, CA (US)

(72) Inventors: Kenny Peinado, Richmond, CA (US); Jay Parekh, Albany, CA (US); Jifei Jia, Hercules, CA (US); Yihua Zhang, Richmond, CA (US); Guan-Dao Lei, Walnut Creek, CA (US); Guang Zhang, Walnut Creek, CA (US)

(73) Assignee: CHEVRON U.S.A. INC.

( * ) Notice: Subject to any disclaimer, the term of this patent is extended or adjusted under 35 U.S.C. 154(b) by 0 days.

(21) Appl. No.: 18/260,223

(22) PCT Filed: Dec. 24, 2021

(86) PCT No.: PCT/IB2021/062287

§ 371 (c)(1),
(2) Date: Jun. 30, 2023

(87) PCT Pub. No.: WO2022/144740

PCT Pub. Date: Jul. 7, 2022

(65) Prior Publication Data

US 2024/0076563 A1 Mar. 7, 2024

Related U.S. Application Data

(63) Continuation of application No. 17/138,009, filed on Dec. 30, 2020, now Pat. No. 11,441,085.

(51) Int. Cl.
*C10G 67/02* (2006.01)
*C10M 101/02* (2006.01)
(Continued)

(52) U.S. Cl.
CPC ..... *C10G 67/02* (2013.01); *C10M 101/02* (2013.01); *C10M 177/00* (2013.01);
(Continued)

(58) Field of Classification Search
CPC ..... C10G 67/02; C10G 2300/202; C10G 2300/302; C10G 2300/304;
(Continued)

(56) References Cited

U.S. PATENT DOCUMENTS 3,852,207 A 12/1974 Stangeland
4,325,804 A * 4/1982 Everett ..... C10G 65/12 208/143
(Continued)

FOREIGN PATENT DOCUMENTS

CA 2220660 * 1/1997
CA 2220660 C * 4/2007 ..... G01N 33/2829
(Continued)

OTHER PUBLICATIONS

International Search Report, issued on Mar. 24, 2022, during the prosecution of International Application No. PCT/IB2021/062287.
(Continued)

*Primary Examiner* — Randy Boyer
*Assistant Examiner* — Juan C Valencia
(74) *Attorney, Agent, or Firm* — Mark Warzel

(57) ABSTRACT

Provided in one embodiment is an improved and more flexible process for preparing a finished base oil or a white oil product comprising passing a dewaxed base oil product to a distillation column and separating the dewaxed base oil product into fuel and base oil product streams. The base oil product streams are tested to determine if they meet desired specifications. Base oil product streams that meet the desired
(Continued)

minimum base oil specifications are passed to a hydrofinishing reactor to prepare a white oil product, or passed to direct sale.

10 Claims, 1 Drawing Sheet

(51) Int. Cl.
*C10M 177/00* (2006.01)
*C10N 70/00* (2006.01)

(52) U.S. Cl.
CPC . *C10G 2300/202* (2013.01); *C10G 2300/302* (2013.01); *C10G 2300/304* (2013.01); *C10G 2300/308* (2013.01); *C10G 2400/04* (2013.01); *C10G 2400/10* (2013.01); *C10G 2400/14* (2013.01); *C10M 2203/1006* (2013.01); *C10N 2070/00* (2013.01)

(58) Field of Classification Search
CPC ..... C10G 2300/308; C10G 2400/04; C10G 2400/10; C10G 2400/14; C10M 101/02; C10M 177/00; C10M 2203/1006; C10N 2070/00
See application file for complete search history.

(56) References Cited

U.S. PATENT DOCUMENTS

| | | | | |
|---|---|---|---|---|
| 6,517,704 | B1 | 2/2003 | Carroll et al. | |
| 8,192,612 | B2 | 6/2012 | Rosenbaum | |
| 8,475,648 | B2 | 7/2013 | Krishna | |
| 8,790,507 | B2 | 7/2014 | Krishna | |
| 2004/0065588 | A1* | 4/2004 | Genetti | C10G 65/16 208/108 |
| 2004/0104145 | A1 | 6/2004 | Germaine | |
| 2006/0016724 | A1* | 1/2006 | Miller | C10G 45/64 208/97 |
| 2006/0201851 | A1* | 9/2006 | Rosenbaum | C10G 7/003 208/18 |
| 2017/0283729 | A1* | 10/2017 | Pathare | C10M 101/02 |
| 2020/0190415 | A1* | 6/2020 | Gong | C10G 73/04 |
| 2021/0087477 | A1* | 3/2021 | Lee | C10G 67/14 |

FOREIGN PATENT DOCUMENTS

| | | | |
|---|---|---|---|
| CN | 102869753 | A | 1/2013 |
| CN | 103102947 | A | 5/2013 |
| CN | 103102956 | A | 5/2013 |
| JP | 2004528427 | A | 9/2004 |
| JP | 2011236439 | A | 11/2011 |
| JP | 2017043688 | A | 3/2017 |
| RU | 2393201 | C2 | 6/2010 |
| RU | 2494140 | C2 | 9/2013 |
| RU | 2724602 | C1 | 6/2020 |

OTHER PUBLICATIONS

Written Opinion of the International Searching Authority, issued on Mar. 24, 2022, during the prosecution of International Application No. PCT/IB2021/062287.

* cited by examiner

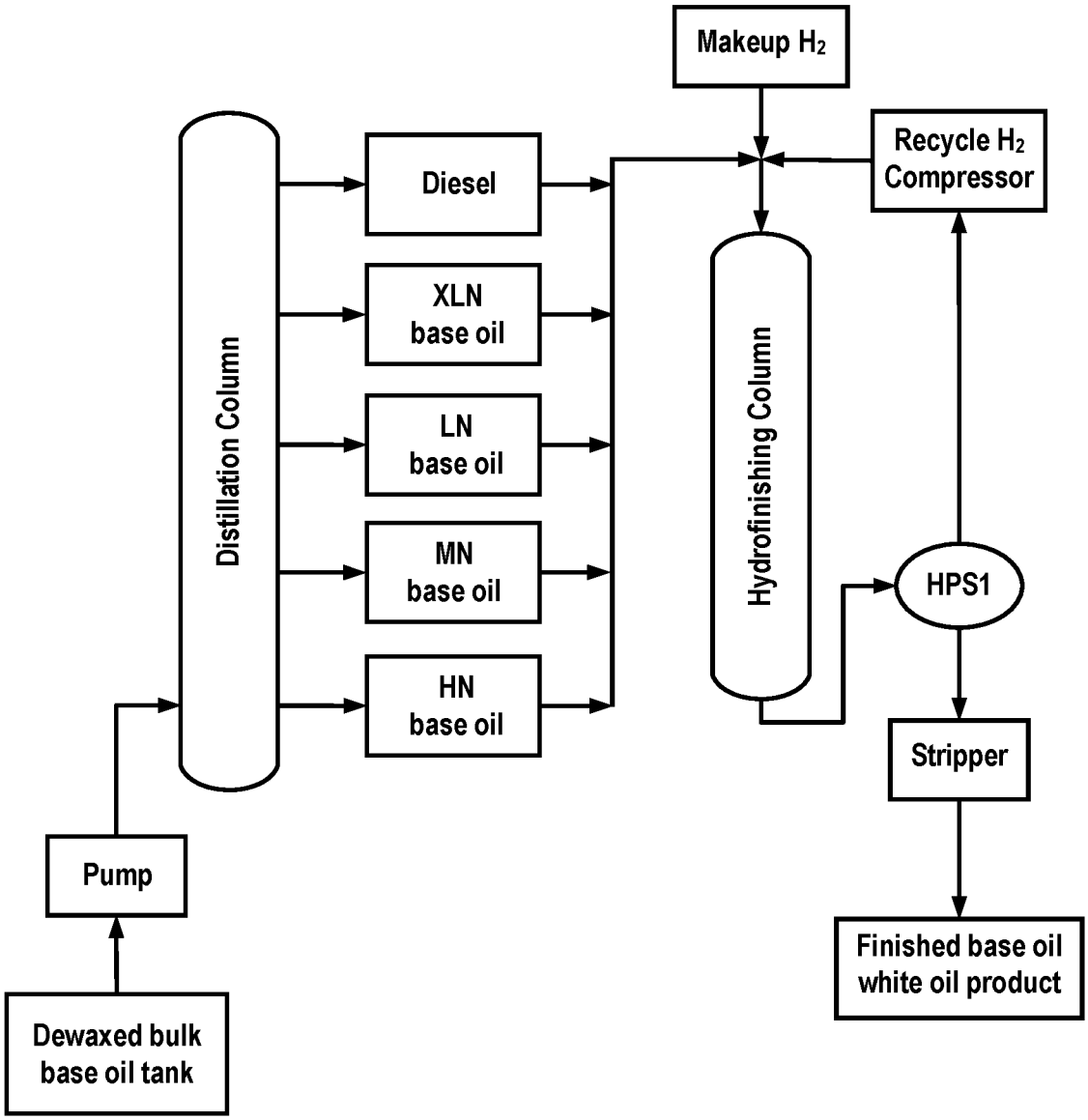
Makeup $H_2$
Recycle $H_2$ Compressor
Diesel
XLN base oil
LN base oil
MN base oil
HN base oil
Distillation Column
Hydrofinishing Column
HPS1
Stripper
Pump
Finished base oil white oil product
Dewaxed bulk base oil tank

PROCESS TO MAKE FINISHED BASE OILS AND WHITE OILS FROM DEWAXED BULK BASE OILS

CROSS REFERENCE TO RELATED APPLICATIONS

This application is related to the following applications, and claims the benefit of priority thereto, as a 371 application of PCT/IB2021/062287, filed on Dec. 24, 2021; which is a continuation of U.S. Provisional Patent Appl. Ser. No. 63/138,009, filed on Dec. 30, 2020, the disclosures of which are herein incorporated in their entirety.

TECHNICAL FILED

Process for preparing high quality base oils and white oil from a dewaxed hydrocarbon feedstock.

BACKGROUND

High quality lubricating oils are critical for the operation of modern machinery and motor vehicles. Finished lubricants used for automobiles, diesel engines, axles, transmissions, and industrial applications consist of two general components, a base oil and one or more additives. Base oil is the major constituent in these finished lubricants and contributes significantly to the properties of the finished lubricant. In general, a few base oils are used to manufacture a wide variety of finished lubricants by varying the mixtures of individual base oils and individual additives. Most crude oil fractions require moderate to significant upgrading to be suitable for lubricant manufacture. As an example, high-quality lubricating oils must often be produced from waxy feeds. Numerous processes have been proposed for producing lubricating base oils by upgrading ordinary and low quality feedstocks.

Hydrocarbon feedstocks may be catalytically dewaxed by hydrocracking or hydroisomerization. Hydrocracking generally leads to a loss in yield due to the production of lower molecular weight hydrocarbons, such as middle distillates and even lighter $C_4$-products, whereas hydroisomerization generally provides higher yields by minimizing cracking.

U.S. Pat. No. 8,475,648 describes processes and a catalyst for dewaxing a heavy hydrocarbon feedstock to form a lubricant base oil. A layered catalyst system is used. See also U.S. Pat. No. 8,790,507. U.S. Pat. No. 8,192,612 describes processes for preparing a base oil slate from a waxy feed. The disclosure of the foregoing patents are incorporated herein by reference in their entirety.

The flexibility of the overall process, however, can have a large impact on the economic viability of the base oil process. The need for improved processes offering more flexibility and hence greater economic benefits in preparing high quality base oils, and white oil products, is important to the industry.

SUMMARY

Provided in one embodiment is a process for preparing a finished base oil or a white oil product comprising passing a dewaxed bulk base oil to a distillation column and separating the dewaxed bulk base oil into fuel and base oil products. The base oil products are tested to determine if they meet desired specifications. In one embodiment, the specifications include pour point, viscosity and viscosity index. The base oil products which meet these minimum desired specifications for base oils might be passed to a final use or a direct sale. To make white oils and/or meet a more stringent aromatics specification, the base oil products might be passed to a hydrofinishing reactor.

In one embodiment, a process is provided for preparing base oils from a waxy hydrocarbon feedstock. The process comprises contacting a hydrocarbon feedstock in a hydroismerization zone under hydroisomerization dewaxing conditions. A dewaxed product is collected from the hydroisomerization zone and passed to a distillation column. The dewaxed bulk product is separated into fuel and base oil products by the distillation column. The base oil products are tested to determine if they meet desired specifications. In one embodiment, the specifications include pour point, viscosity and viscosity index. The base oil products which meet these minimum desired specifications for base oils might be passed to a final use or a direct sale. To make white oils and/or meet a more stringent aromatics specification, the base oil products might be passed to a hydrofinishing reactor.

Among other factors, the present processes offer greater flexibility and control over the base oil process. The analysis of the separated base oil streams obtained from the dewaxed bulk base oil prior to hydrofinishing permits choices and a tailoring of reaction conditions to create an improved economic process for obtaining high quality, useable base oils as well as white oils.

BRIEF DESCRIPTION OF THE DRAWING

The drawing FIGURE depicts one embodiment of the present process.

DETAILED DESCRIPTION

The present process makes finished base oils and white oils from a dewaxed bulk base oil. Once a hydrocarbon feedstock is dewaxed, the resulting dewaxed bulk base oil is distilled and fractionated into different grades of base oils and fuels. Each grade of base oil is analyzed to determine whether it passes relevant or desired base oil specifications. In one embodiment, the specifications include pour point, viscosity and viscosity index. The specifications differ for each grade of base oil, with acceptable specifications well known in the industry. Other tests can include UV for aromatics, cloud point or Noack. The specifications considered will always differ based on the ultimate intended product.

If the base oil passes the test(s) and meets the suitable specifications, it can be passed on for direct use or direct sale, e.g., as premium base oils. Thus, no further processing is required of these base oil streams. Focus and tailoring of reaction conditions in the hydrofinishing reactor can then be asserted on the remaining streams. Of course, if desired, even if a particular base oil type stream passes the tests, it can still be processed to make a finished base oil and or a white oil by hydrofinishing. If the intention is to make white oil, then most if not all of the base oil products can be passed to hydrofinishing.

Depending on the reactor temperature and pressure used in the hydrofinisher, the final product can be considered a finished base oil or a white oil product. The reactor temperature and pressure can be tailored for the base oil stream being processed to thereby insure the highest quality product. A white oil product can be suitable for and safely used in food processing equipment. It must, however, meet the requisite stringent specifications, including the RCS (readily carbonizable substances) test as in ASTM D 565-88.

If a base oil does not meet the necessary requirements, it can be recycled to the dewaxer or passed to further processing.

By utilizing the testing/analysis of the base oil products obtained by the distillation/fractionation, the present process has been found to offer greater flexibility in the overall process. Instead of passing the entire dewaxed bulk base oil to a hydrofinisher, the present process offers a choice for each of the base oil products recovered. Less base oil need be subjected to hydrofinishing. And, when the choice is made to pass the base oil onto hydrofinishing, the system can be operated at more flexible conditions including feed rate, temperature and hydrogen pressure. The conditions can also be tailored to that base oil type product to insure a high quality finished base oil or white oil product.

Another important advantage is that only one hydrofinishing is used in the present process. Typically, an entire dewaxed product is passed from the dewaxing reactor to a hydrofinisher. The product from the hydrofinisher is then passed to a distillation column. The distillation column can develop compounds which might cause failure of an RCS test, thereby limiting the role of the oil as a white oil product unless the base oil is again hydrofinished. Thus, two hydrofinishing runs become necessary. In the present process, however, the distillation column precedes the hydrofinisher and thereby avoids such an unfortunate result. The present process is therefore much more efficient.

In one embodiment, to obtain the dewaxed bulk base oil, a waxy hydrocarbon feed is subjected to a dewaxing process. The term "waxy feed" as used in this disclosure refers to a feed having a high content of normal paraffins (n-paraffins). A waxy feed useful in the practice of the present process scheme will generally comprise at least 40 wt. % n-paraffins, preferably greater than 50 wt. % n-paraffins, and more preferably greater than 75 wt. % n-paraffins. Preferably, the waxy feed used in the process will also have very low levels of nitrogen and sulfur, generally less than 25 ppm total combined nitrogen and sulfur and preferably less than 20 ppm. This can be achieved by hydrotreating before dewaxing.

A wide variety of hydrocarbon feedstocks can be used, including whole crude petroleum, reduced crudes, vacuum tower residua, synthetic crudes, Fischer-Tropsch derived waxes, and the like. Typical feedstocks can include hydrotreated or hydrocracked gas oils, hydrotreated lube oil raffinates, brightstocks, lubricating oil stocks, synthetic oils, foots oils, Fischer-Tropsch synthesis oils, high pour point polyolefins, normal alphaolefin waxes, slack waxes, deoiled waxes and microcrystalline waxes. Other hydrocarbon feedstocks suitable for use in processes of the present process scheme may be selected, for example, from gas oils and vacuum gas oils; residuum fractions from an atmospheric pressure distillation process; solvent-deasphalted petroleum residua; shale oils, cycle oils; animal and vegetable derived fats, oils and waxes; petroleum and slack wax; and waxes produced in chemical plant processes.

In an embodiment, the hydrocarbon feedstocks can be described as waxy feeds having pour points generally above about 0° C., and having a tendency to solidify, precipitate, or otherwise form solid particulates upon cooling to about 0° C. Straight chain n-paraffins, either alone or with only slightly branched chain paraffins, having 16 or more carbon atoms may be referred to herein as waxes. The feedstock will usually be a $C_{10+}$ feedstock generally boiling above about 350° F. (177° C.). In contrast, the base oil products of the present processes, resulting from hydroisomerization dewaxing of the feedstock, generally have pour points below 0° C., typically below about −12° C., and often below about −14° C.

The present process scheme may also be suitable for processing waxy distillate stocks such as middle distillate stocks including gas oils, kerosenes, and jet fuels, lubricating oil stocks, heating oils, and other distillate fractions whose pour point and viscosity need to be maintained within certain specification limits.

Feedstocks for processes of the present process scheme can, in one embodiment, include olefin and naphthene components, as well as aromatic and heterocyclic compounds, in addition to higher molecular weight n-paraffins and slightly branched paraffins. During processes of the present scheme, the degree of cracking of n-paraffins and slightly branched paraffins in the feed is strictly limited so that the product yield loss is minimized, thereby preserving the economic value of the feedstock.

In an embodiment, the feedstock may comprise a heavy feed. Herein, the term "heavy feed" may be used to refer to a hydrocarbon feedstock wherein at least about 80% of the components have a boiling point above about 900° F. (482° C.). Examples of heavy feeds suitable for practicing the present process scheme include heavy neutral (600N) and bright stock.

According to one aspect of the present processes, a wide range of feeds may be used to produce lubricant base oils in high yield with good performance characteristics, including low pour point, low cloud point, low pour-cloud spread, and high viscosity index. The quality and yield of the lube base oil product of the instant process may depend on a number of factors, including the formulation of the hydroisomerization catalysts comprising the layered catalyst systems and the configuration of the catalyst layers of the catalyst systems.

According to one embodiment of the present process scheme, a catalytic dewaxing process for the production of base oils from a waxy hydrocarbon feedstock may involve introducing the feed into a reactor containing a dewaxing catalyst system. Hydrogen gas may also be introduced into the reactor so that the process may be performed in the presence of hydrogen, e.g., as described herein below with reference to the process conditions.

Within the reactor, the feed may be contacted with a hydrotreating catalyst under hydrotreating conditions in a hydrotreating zone or guard layer to provide a hydrotreated feedstock. Contacting the feedstock with the hydrotreating catalyst in the guard layer may serve to effectively hydrogenate aromatics in the feedstock, and to remove N- and S-containing compounds from the feed, thereby protecting the first and second hydroisomerization catalysts of the catalyst system. By "effectively hydrogenate aromatics" is meant that the hydrotreating catalyst is able to decrease the aromatic content of the feedstock by at least about 20%. The hydrotreated feedstock may generally comprise $C_{10+}$ n-paraffins and slightly branched isoparaffins, with a wax content of typically at least about 20%.

Hydroisomerization catalysts useful in the dewaxing process typically will contain a catalytically active hydrogenation metal. The presence of a catalytically active hydrogenation metal leads to product improvement, especially VI and stability. Typical catalytically active hydrogenation metals include chromium, molybdenum, nickel, vanadium, cobalt, tungsten, zinc, platinum, and palladium. The metals platinum and palladium are especially preferred. If platinum and/or palladium is used, the total amount of active hydrogenation metal is typically in the range of 0.1 wt. % to 5 wt. % of the total catalyst, usually from 0.1 wt. % to 2 wt. %.

The refractory oxide support may be selected from those oxide supports, which are conventionally used for catalysts, including silica, alumina, silica-alumina, magnesia, titania and combinations thereof.

In one embodiment, the dewaxing process involves using a layered catalyst system. The layered catalyst system may comprise first and second hydroisomerization catalysts, wherein the first hydroisomerization is disposed upstream from the second hydroisomerization catalyst. The first hydroisomerization catalyst may have a first level of selectivity for the isomerization of n-paraffins, the second hydroisomerization catalyst may have a second level of selectivity for the isomerization of n-paraffins. In an embodiment, the first and second levels of selectivity may be the same or at least substantially the same.

The conditions under which the dewaxing process is carried out will generally include a temperature within a range from about 390° F. to about 800° F. (199° C. to 427° C.). In an embodiment, each of the first and second hydroisomerization dewaxing conditions includes a temperature in the range from about 550° F. to about 700° F. (288° C. to 371° C.). In a further embodiment, the temperature may be in the range from about 590° F. to about 675° F. (310° C. to 357° C.). The pressure may be in the range from about 15 to about 3000 psig (0.10 to 20.68 MPa), and typically in the range from about 100 to about 2500 psig (0.69 to 17.24 MPa).

Typically, the feed rate to the catalyst system/reactor during dewaxing processes of the present invention may be in the range from about 0.1 to about 20 $h^{-1}$ LHSV, and usually from about 0.1 to about 5 h LHSV. Generally, dewaxing processes of the present invention are performed in the presence of hydrogen. Typically, the hydrogen to hydrocarbon ratio may be in a range from about 2000 to about 10,000 standard cubic feet $H_2$ per barrel hydrocarbon, and usually from about 2500 to about 5000 standard cubic feet $H_2$ per barrel hydrocarbon.

The above conditions may apply to the hydrotreating conditions of an optional hydrotreating zone, as well as to the hydroisomerization conditions. The reactor temperature and other process parameters may vary according to factors such as the nature of the hydrocarbon feedstock used and the desired characteristics (e.g., pour point, cloud point, VI) and yield of the base oil product.

The bulk base oil product is passed to a distillation column, which can be a vacuum distillation tower, to separate the product into fuel and different base oil type products. The distillation column is generally run under conventional conditions to effect a separation of fuel and various base oil products.

Base oils recovered from the distillation column can include a range of base oils grades. Typical base oil grades recovered from the distillation column include, but are not necessarily limited to, XXLN, XLN, LN, and MN. An XXLN grade of base oil when referred to in this disclosure is a base oil having a kinematic viscosity at 100° C. between about 1.5 cSt and about 3.0 cSt, preferably between about 1.8 cSt and about 2.3 cSt. An XLN grade of base oil will have a kinematic viscosity at 100° C. between about 1.8 cSt and about 3.5 cSt, preferably between about 2.3 cSt and about 3.5 cSt. A LN grade of base oil will have a kinematic viscosity at 100° C. between about 3.0 cSt and about 6.0 cSt, preferably between about 3.5 cSt and about 5.5 cSt. An MN grade of base oil will have a kinematic viscosity at 100° C. between about 5.0 cSt and about 15.0 cSt, preferably between about 5.5 cSt and about 10.0 cSt. In addition to the various base oil grades, a diesel product may also be recovered from the distillation column.

Diesel fuels prepared/separated out as part of the product slate will generally have a boiling range between about 65° C. (about 150° C.) and about 400° C. (about 750° C.), typically between about 205° C. (about 400° F.) and about 315° C. (about 600° F.). The recovered diesel fuel can be passed on to further processing or use.

The various base oil grades are tested. Generally, the testing would include pour point, viscosity and viscosity index determinations. Other tests might be made to analyze cloud point, Noack or aromatic content. The requisite specifications will vary for each grade of base oil, and desired specifications can vary depending on the ultimate product desired. Once analyzed, it can be determined if the particular base oil product meets the desired specifications for the intended end use or is suitable for direct sale as premium base oil. The base oil product can also be passed to a hydrofinishing reactor.

Such hydrofinishing may be performed in the presence of a hydrogenation catalyst, as is known in the art. The hydrogenation catalyst used for hydrofinishing may comprise, for example, platinum, palladium, or a combination thereof on an alumina support. The hydrofinishing may be performed at a temperature in the range from about 350° F. to about 650° F. (176° C. to 343° C.), and a pressure in the range from about 400 psig to about 4000 psig (2.76 to 27.58 MPa). Hydrofinishing for the production of lubricating oils is described, for example, in U.S. Pat. No. 3,852,207, the disclosure of which is incorporated by reference herein.

The product from the hydrofinisher can be quality white oil. The product is often tested to insure it meets the stringent requirements to be used safely in food. The tests include the RCS test (ASTM D 565-88). The tests might also include a UV absorbance test (D2269).

Further illustration of the present process can be obtained upon a review of the FIGURE of the Drawing and the following examples. The flexibility and efficiency of the present process are described and demonstrated. The FIGURE and the examples are merely meant to be illustrative and not limiting.

Example 1

Table 1 below summarizes the properties of a hydrodewaxed stream that can be fed to a distillation column. The feed stream is a full range bulk hydrodewaxed intermediate product, having a distillation range from 426° F. to 1355° F. The pour point was reduced to −44° C. after the hydrodewaxing process. The UV absorbance at 226 nm is around 0.0928, which indicates that the aromatics content is ~0.45 wt. %.

TABLE 1

Properties of the Hydrodewaxed Stream

| Sample | Hydrodewaxed Stream |
|---|---|
| API | 41.5 |
| Density at 15.6° C., g/cc (D4052) | 0.818 |
| Sulfur, ppm (D2622) | <5 |
| Aromatics by UV, wt. % | 0.45 |
| VI (D2270) | 178 |
| Vis at 40° C. D445) | 25.58 |
| Vis at 100° C. D445) | 5.754 |
| Pour Point, ° C. (D97) | −44 |

TABLE 1-continued

| Properties of the Hydrodewaxed Stream | |
|---|---|
| RCS | 15 |
| UV absorbance | au. |
| 226 nm | 0.0928 |
| 255 nm | 0.0127 |
| 272 nm | 0.0123 |
| 305 nm | 0.0039 |
| 310 nm | 0.0027 |
| 340 nm | 0.007 |
| 348 nm | 0.006 |
| 385 nm | 0.0000 |
| 435 nm | 0.0000 |
| 450 nm | 0.0000 |
| 495 nm | 0.0000 |
| Simdist wt. % | ° F. |
| 0.5 | 426 |
| 5 | 542 |
| 10 | 598 |
| 30 | 744 |
| 50 | 854 |
| 70 | 983 |
| 90 | 1197 |
| EP | 1355 |

As illustrated by the process diagram in the FIGURE, the hydrodewaxed stream is separated into 5 product streams through the distillation column, including diesel, extra light neutral (XLN), light neutral (LN), medium neutral (MN), and heavy neutral (HN). Table 2 below summarizes the properties for all the distillation products. All products can be used for direct sale as diesel or Group III/III+ premium base oils. The UV absorbance at 226 nm is in the range of 0.05 to 0.18, suggesting the aromatics content is below 1% for all products. However, the Readily carbonizable substances (RCS) test shows 17 for XLN, LN and MN. This is evidence that the distillated base oil products do not meet food grade white oil specifications.

TABLE 2

| Distillation Products Properties | | | | | |
|---|---|---|---|---|---|
| Distillation Products | Diesel | XLN | LN | MN | HN |
| API | 47.2 | 43.5 | 42.2 | 39.8 | 36.5 |
| Density at 15.6° C., g/cc (D4052) | 0.792 | 0.809 | 0.815 | 0.826 | 0.842 |
| Sulfur, ppm (D2622) | <5 | <5 | <5 | <5 | <5 |
| Aromatics by UV, wt. % | 0.34 | 0.28 | 0.30 | 0.45 | 0.89 |
| VI (D2270) | | 126 | 139 | 157 | 161 |
| Vis at 40° C. (D445) | 4.555 | 10.75 | 15.85 | 38.89 | 218 |
| Vis at 100° C. (D445) | 1.634 | 2.922 | 3.845 | 7.341 | 27.37 |
| Pour Point, ° C. (D97) | −58 | −42 | −37 | −28 | −23 |
| RCS | 15 | 17 | 17 | 17 | — |
| UV absorbance | | | au. | | |
| 226 nm | 0.0687 | 0.0563 | 0.0621 | 0.0912 | 0.1822 |
| 255 nm | 0.0064 | 0.0086 | 0.0107 | 0.0165 | 0.0308 |
| 272 nm | 0.0073 | 0.0075 | 0.0093 | 0.0147 | 0.0277 |
| 305 nm | 0.0014 | 0.0021 | 0.0027 | 0.0053 | 0.0104 |
| 310 nm | 0.0009 | 0.0014 | 0.0020 | 0.0039 | 0.0079 |
| 340 nm | 0.0002 | 0.0007 | 0.0009 | 0.0013 | 0.0025 |
| 348 nm | 0.0001 | 0.0004 | 0.0009 | 0.0012 | 0.0021 |
| 385 nm | 0.0000 | −0.0001 | 0.0001 | 0.0004 | 0.0006 |
| 435 nm | 0.0000 | −0.0001 | 0.0001 | 0.0001 | 0.0001 |
| 450 nm | −0.0001 | −0.0001 | 0.0001 | 0.0001 | 0.0001 |
| 495 nm | 0.0000 | 0.0000 | 0.0000 | 0.0000 | 0.0000 |
| Simdist wt. % | | | ° F. | | |
| 0.5 | 391 | 651 | 710 | 796 | 802 |
| 5 | 474 | 684 | 741 | 831 | 874 |
| 10 | 505 | 697 | 754 | 847 | 903 |
| 30 | 574 | 723 | 779 | 889 | 978 |
| 50 | 622 | 739 | 797 | 928 | 1049 |
| 70 | 663 | 754 | 815 | 971 | 1137 |
| 90 | 704 | 774 | 838 | 1031 | 1355 |
| EP | 749 | 810 | 878 | 1138 | 1355 |

Example 2

The present process adds the flexibility to further upgrade the base oil products to meet white oil specifications by sending the individual base oil block to a hydrofinishing section. This is shown in the FIGURE of the Drawing. The product can be further upgraded to food grade or cosmetic grade by saturating aromatics to reduce the aromatics content. The hydrofinishing section can be optimized with minimal scale and investment because of the smaller block flow. Moreover, the system can be operated at more flexible conditions including feed rate, temperature and hydrogen pressure.

The reactor in the hydrofinishing section is installed with a hydrofinishing catalyst, which can comprise Pt/Pd and silica alumina as disclosed in U.S. Pat. No. 8,790,507, the entirety of which is incorporated herein by reference. The reaction was performed under 1140 psig total pressure. The MN stream (as listed in Table 2) was passed through the hydrofinishing reactor at a LHSV of 2 $hr^{-1}$. The hydrogen to oil ratio is about 3000 scfb. The reactor was operated at 450 F. The hydrofinished base oil product was analyzed for UV absorbance, RCS and ASTM D2269 (UV test after DMSO extraction). The results are summarized in Table 3 and Table 4 below. The UV absorbance test shows that the 226 nm has been reduced significantly after hydrofinishing and the aromatics content was decreased from ~0.45% to 0.001%. RCS and ASTM D2269 tests show that the MN white oil product meets food grade white oil specifications.

TABLE 3

MN White Oil Properties

| Hydrofinished Product | MN White Oil |
|---|---|
| Aromatics by UV, wt % | 0.001 |
| VI (D2270) | 157 |
| Vis at 40° C. (D445) | 38.87 |
| Vis at 100° C. (D445) | 7.339 |
| Pour Point, ° C. (D97) | −38 |
| RCS | 4 |
| **UV absorbance** | **au.** |
| 226 nm | 0.0002 |
| 255 nm | 0.00007 |
| 272 nm | 0.00005 |
| 305 nm | 0.00009 |
| 310 nm | 0.00011 |
| 340 nm | 0.00003 |
| 348 nm | 0.00003 |
| 385 nm | 0.00001 |
| 435 nm | 0 |
| 450 nm | 0.00001 |
| 495 nm | 0 |
| **Simdist wt %** | **° F.** |
| 0.5 | 796 |
| 5 | 829 |
| 10 | 844 |
| 30 | 886 |
| 50 | 926 |
| 70 | 969 |
| 90 | 1029 |
| EP | 1123 |

TABLE 4

MN White Oil ASTM D2269 Test Results

| Hydrofinished Product UV absorbance (ASTM D2269) | MN White Oil au. |
|---|---|
| 260-279 nm | 0.068 |
| 280-289 nm | 0.034 |
| 290-299 nm | 0.037 |
| 300-329 nm | 0.031 |
| 330-350 nm | 0.016 |

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

Numerous variations of the present invention may be possible in light of the teachings and examples herein. It is therefore understood that within the scope of the following claims, the invention may be practiced otherwise than as specifically described or exemplified herein

What is claimed is:

1. A process for preparing a white oil product comprising:

a) passing a dewaxed base oil product to a distillation column and separating the dewaxed base oil product into diesel fuel and base oil products;

b) testing the base oil products to determine if they meet minimum desired specifications;

c) passing a base oil product which meets the desired specifications to a hydrofinishing reactor to then meet white oil specifications; and d) collecting a base oil stream from the hydrofinishing reactor and testing for UV absorbance (ASTM D2269);

wherein the base oil products include XLN base oil having a kinematic viscosity at 100° C. between about 1.8 cSt and about 3.5 cSt, LN base oil having a kinematic viscosity at 100° C. between about 3.0 cSt and about 6.0 cSt, and MN base oil having a kinematic viscosity at 100° C. between about 5.0 cSt and about 15.0 cSt.

2. The process of claim 1, wherein the minimum desired specifications include pour point, viscosity and viscosity index.

3. The process of claim 1, wherein the dewaxed product is separated into a diesel fuel product and up to four base oil products.

4. The process of claim 1, wherein the hydrofinishing reactor comprises a hydrofinishing catalyst and the hydrofinishing catalyst comprises a silica alumina based catalyst further containing platinum and/or palladium.

5. A process for preparing base oil from a waxy hydrocarbon feedstock comprising:

a) contacting the hydrocarbon feedstock in a hydroismerization zone under hydroisomerization dewaxing conditions;

b) collecting a dewaxed product stream from the hydroisomerization zone and passing the product streams to a distillation column;

c) separating the dewaxed product stream into fuel and base oil products in the distillation column;

d) testing the base oil products to determine if they meet minimum desired specifications, wherein the testing comprises one or more tests of cloud point, Noack, pour point, viscosity, aromatic content, or viscosity index;

e) passing a base oil product which meets the minimum desired specifications for a base oil product to a hydrofinishing reactor to meet more stringent specifications, or to a further use or direct sale; and f) passing any base oil product which does not meet a minimum desired specification for a base oil product to a hydroisomerization dewaxer, to further processing, a further use, or direct sale;

wherein the base oil products include XLN base oil having a kinematic viscosity at 100° C. between about 1.8 cSt and about 3.5 cSt, LN base oil having a kinematic viscosity at 100° C. between about 3.0 cSt and about 6.0 cSt, and MN base oil having a kinematic viscosity at 100° C. between about 5.0 cSt and about 15.0 cSt;

wherein, a base oil product stream is passes to a hydrofinishing reactor and a hydrofinished product is collected from the reactor and tested for readily carbonizable substances.

6. The process of claim 5, wherein the dewaxed product is separated into product streams comprising diesel fuel and base oil product streams.

7. The process of claim 5, wherein the desired minimum specifications include pour point, viscosity and viscosity index.

8. The process of claim 5, wherein the hydrofinishing reactor comprises a hydrofinishing catalyst and the hydrofinishing catalyst comprises a silica alumina based catalyst further containing platinum and/or palladium.

9. The process of claim 5, wherein the base oil product stream collected from the hydrofinishing reactor is tested for UV absorbance (ASTM D2269).

10. The process of claim 5, wherein the base oil stream that fails to meet the desired specifications is recycled to the hydroisomerization zone in a).

* * * * *